US009412324B2

(12) United States Patent
Kobayashi et al.

(10) Patent No.: US 9,412,324 B2
(45) Date of Patent: Aug. 9, 2016

(54) DRIVE DEVICE AND DISPLAY DEVICE

(71) Applicant: Sharp Kabushiki Kaisha, Osaka-shi, Osaka (JP)

(72) Inventors: Fumiyuki Kobayashi, Osaka (JP); Asahi Yamato, Osaka (JP); Kohzoh Takahashi, Osaka (JP); Taketoshi Nakano, Osaka (JP); Toshihiro Yanagi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 59 days.

(21) Appl. No.: 14/376,893

(22) PCT Filed: Feb. 21, 2013

(86) PCT No.: PCT/JP2013/054398

§ 371 (c)(1),
(2) Date: Aug. 6, 2014

(87) PCT Pub. No.: WO2013/129239

PCT Pub. Date: Sep. 6, 2013

(65) Prior Publication Data

US 2015/0015555 A1 Jan. 15, 2015

(30) Foreign Application Priority Data

Feb. 29, 2012 (JP) ..... 2012-044617

(51) Int. Cl.
*G09G 3/36* (2006.01)
*G09G 3/20* (2006.01)

(52) U.S. Cl.
CPC ..... *G09G 3/3677* (2013.01); *G09G 3/2092* (2013.01); *G09G 3/3614* (2013.01); *G09G 3/3648* (2013.01); *G09G 2300/0842* (2013.01); *G09G 2310/0202* (2013.01); *G09G 2310/08* (2013.01); *G09G 2330/021* (2013.01); *G09G 2330/027* (2013.01)

(58) Field of Classification Search
CPC . G09G 3/3648; G09G 3/3614; G09G 3/2092; G09G 3/3677; G09G 2330/021; G09G 2330/027; G09G 2310/08; G09G 2300/0842; G09G 2310/0202; G09G 3/36
See application file for complete search history.

(56) References Cited

U.S. PATENT DOCUMENTS

| | | | | |
|---|---|---|---|---|
| 6,504,523 | B1 * | 1/2003 | Sugawara et al. | 345/98 |
| 2011/0175883 | A1 | 7/2011 | Toyotaka et al. | |
| 2011/0267381 | A1 * | 11/2011 | Yamazaki et al. | 345/690 |

FOREIGN PATENT DOCUMENTS

| | | | |
|---|---|---|---|
| JP | 2001-154171 | A | 6/2001 |
| JP | 2011-170327 | A | 9/2011 |
| WO | 2012/161022 | A1 | 11/2012 |

OTHER PUBLICATIONS

Official Communication issued in International Patent Application No. PCT/JP2013/054398, mailed on May 14, 2013.

* cited by examiner

*Primary Examiner* — Md Saiful A Siddiqui
(74) *Attorney, Agent, or Firm* — Keating & Bennett, LLP

(57) ABSTRACT

A drive device of the present invention includes a VCOM selection circuit (122) for switching, before a display panel (102) is turned off, an electric potential of a counter electrode COM of each of pixels P from a VCOM1 to a VCOM2 which causes an electric potential of a drain electrode of each of the pixel P to be identical to the electric potential of the counter electrode COM after the display panel (102) is turned off.

13 Claims, 4 Drawing Sheets

DRIVE DEVICE AND DISPLAY DEVICE

TECHNICAL FIELD

The present invention relates to a drive device and a display device.

BACKGROUND ART

In recent years, relatively thin display devices such as liquid crystal display devices have been widely used in various types of information devices such as electronic book devices, smartphones, mobile phones, PDAs (portable information devices), laptop personal computers, portable gaming devices, and car navigation devices. These display devices are confronted with challenges such as reduction in electric power consumption and improvement in display image quality. Under such circumstances, there have been various proposed technologies intended to overcome the challenges of the display devices.

For example, there is a proposed technology in which (i) scanning periods, in which image data is written into pixels, and non-scanning periods, in which image data is not written into the pixels, are provided and (ii) the image data written into the pixels during the scanning periods are stored in the pixels during the non-scanning periods. This technology causes a reduction in frequency of writing the image data into the pixels, and therefore allows a reduction in power consumption of a display device.

In a case where such a technology is put to use, however, such a problem may arise that image data remains stored in pixels even after a display device is turned off. Such a problem may lead to defects such as image-stuck pixels and liquid crystal deterioration.

Under the circumstances, Patent Literature 1 discloses, as a technology to solve the problem, a technology in which a difference in electric potential between electrodes of a capacitor element of each pixel is eliminated by writing a fixed electric potential into the capacitor element before terminating a power supply of a liquid crystal display device. This technology allegedly prevents liquid crystal deterioration by preventing an electric potential from being continuously applied to the liquid crystals after the power supply of the liquid crystal display device is terminated.

CITATION LIST

Patent Literature

Patent Literature 1

Japanese Patent Application Publication, Tokukai, No. 2011-170327 (Publication Date: Sep. 1, 2011)

SUMMARY OF INVENTION

Technical Problem

According to the technology disclosed in Patent Literature 1, an electric potential difference between electrodes of a capacitor element is eliminated. However, an electric potential at a drain electrode changes when a power supply of a liquid crystal display device is terminated. This causes a difference in electric potential to be generated between a counter electrode and the drain electrode. The cause of such a phenomenon will be described below with reference to FIG. 5.

(Example of how Conventional Display Device Carries Out Control)

FIG. 5 is a timing chart showing timings of various operations in a conventional display device. In particular, FIG. 5 shows timings of various operations when the display device is turned off.

(a) of FIG. 5 shows an electric potential of a source electrode of a TFT included in a pixel. (b) of FIG. 5 shows an electric potential of a drain electrode of the TFT included in the pixel. (c) of FIG. 5 shows an electric potential of a counter electrode COM included in the pixel. (e) of FIG. 5 shows an electric potential of a gate electrode of the TFT included in the pixel. (f) of FIG. 5 shows a status of a power supply of the display device.

According to the example shown in FIG. 5, the conventional display device is configured such that there are a normal scanning period, a GND scanning period, and a power-OFF period. The "normal scanning period" is a period in which to drive a display panel in accordance with an inputted image signal so as to cause the display panel to display an image based on the image signal. The "ground scanning period" is a period in which to write a GND voltage into each of pixels before the display device is turned off. The "power-OFF period" is a period in which the display device is turned off.

Note that, during the normal scanning period and the ground scanning period, a reference potential V1 of the drain electrode is shifted from the GND toward a negative-value side by an amount of ΔV1 (i.e. is −ΔV1). In accordance with the reference potential V1, a potential VCOM1 of the counter electrode COM is set to a value shifted from the GND toward the negative-value side by the amount of ΔV1 (i.e. is −ΔV1). In other words, the display device is configured such that, during the normal scanning period and the ground scanning period, no electric potential difference is to occur between the reference potential of the drain electrode and the electric potential of the counter electrode COM.

During the power-OFF period, however, the electric potential of the drain electrode is higher than the GND whereas the electric potential of the counter electrode COM is equal to the GND. In other words, there is a difference in electric potential between the drain electrode and the counter electrode COM.

This is because turning off the display device causes the electric potentials of the gate electrode and of the counter electrode COM to each change to the GND, and, as a result, the electric potential of the drain electrode moves higher than the GND.

If a display device encounters such an electric potential difference for an extended period of time, then it leads to defects such as image-stuck pixels and liquid crystal deterioration. Particularly, since display devices of recent years have improved in terms of off-state characteristics of TFTs in pixels, such an electric potential difference is highly likely to continue for an extended period of time.

According to conventional display devices, it is thus impossible to turn off a display panel without causing a difference in electric potential between a drain electrode and a counter electrode of each pixel. The present invention has been made in view of the problem, and it is an object of the present invention to turn off a display panel without causing a difference between an electric potential of a drain electrode and an electric potential of a counter electrode of each pixel.

Solution to Problem

In order to attain the object, a drive device in accordance with an embodiment of the present invention is a drive device for driving a display panel, said display panel including: pixels; gate signal lines; and source signal lines, said drive device including: a scanning line drive circuit for selecting and scanning the gate signal lines one after another; a signal line drive circuit for writing a data signal (i) into each of selected pixels connected to a selected one of the gate signal lines and (ii) via a corresponding one of the source signal lines; and switching means for switching, before the display panel is turned off, an electric potential of a counter electrode of each of the pixels from a first electric potential to a second electric potential which causes an electric potential of a drain electrode of the each of the pixels to be identical to the electric potential of the counter electrode after the display panel is turned off.

A display device in accordance with the embodiment of the present invention includes: a display panel including pixels, gate signal lines, and source signal lines; and the drive device.

Advantageous Effects of Invention

According to an embodiment of the present invention, it is possible to turn off a display panel without causing a difference between an electric potential of a drain electrode and an electric potential of a counter electrode which are included in a pixel.

DESCRIPTION OF EMBODIMENTS

Embodiment 1

The following description will discuss an embodiment of the present invention with reference to the drawings.

(Configuration of Display Device)

Figure 1:
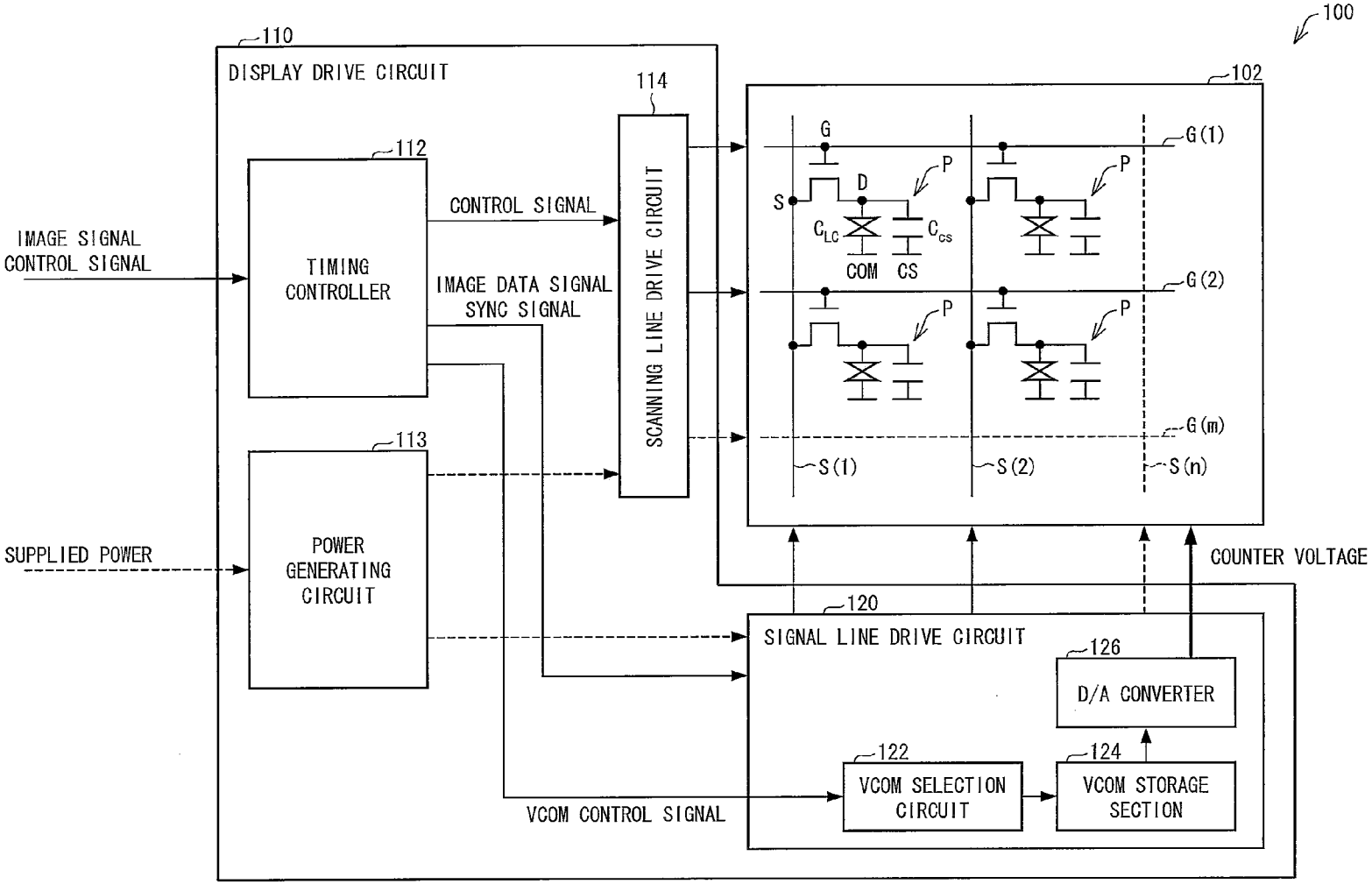
FIG. 1 illustrates a configuration of main components of a display device in accordance with an embodiment.

An example of a configuration of a display device 100 in accordance with the present embodiment will be described first with reference to FIG. 1. FIG. 1 illustrates a configuration of main components of the display device 100.

The display device 100, as a display device for displaying images, is to be mounted on electronic book devices, smartphones, mobile phones, PDAs, laptop personal computers, portable gaming devices, car navigation devices, and the like.

As illustrated in FIG. 1, the display device 100 includes a display panel 102 and a display drive circuit 110.

(Display Panel)

The display panel 102 displays an image in accordance with an image signal inputted into the display device 100. As the display panel 102, what is known as an active-matrix liquid crystal display panel is used. The display panel 102 includes (i) pixels P, (ii) gate signal lines G (m (m is an integer) gate signal lines G(1) through G(m)), and (iii) source signal lines S (n (n is an integer) source signal lines S(1) through S(n)).

The pixels P are arranged in a grid pattern. Specifically, the pixels P form pixel columns and pixel rows (n pixel columns×m pixel rows). According to the present embodiment, a TFT liquid crystal is used for each of the pixels P. The gate signal lines G are provided for the respective pixel rows. Each of the gate signal lines G is provided as a signal channel for supplying a gate signal (scan signal) to each of pixels P of a corresponding one of the pixel rows. The source signal lines S are provided for the respective pixel columns. Each of the source signal lines S is provided as a signal channel for supplying a source signal (image data signal) to each of pixels P of a corresponding one of the pixel columns.

(Display Drive Circuit)

The display drive circuit 110 drives the display panel 102 in accordance with the inputted image signal so as to cause the display panel 102 to display an image based on the image signal. As illustrated in FIG. 1, the display drive circuit 110 includes a timing controller 112, a power generating circuit 113, a scanning line drive circuit 114, and a signal line drive circuit 120.

(Timing Controller)

The timing controller 112 receives an image signal from an external source (e.g. a control section in a system). Examples of the image signal herein encompass a clock signal, a sync signal, and an image data signal. Then, in accordance with the image signal thus received, the timing controller 112 controls operations and operation timings of the drive circuits (the scanning line drive circuit 114 and the signal line drive circuit 120). For example, the timing controller 112 supplies, to the scanning line drive circuit 114, scanning control signals which are GSP, GCK, and GOE. In addition, the timing controller 112 supplies, to the signal line drive circuit 120, an image data signal and a sync signal. The drive circuits are controlled by the timing controller 112 to operate in synchronization with one another, so that the display panel 102 displays an image based on the image signal.

(Power Generating Circuit)

The power generating circuit 113 generates, by use of power supplied from an external source (e.g. a control section in a system), respective voltages necessary for driving the scanning line drive circuit 114 and the signal line drive circuit 120. Then, the power generating circuit 113 supplies the respective voltages thus generated to the scanning line drive circuit 114 and to the signal line drive circuit 120.

(Scanning Line Drive Circuit)

The scanning line drive circuit 114 drives the gate signal lines G in accordance with the scanning control signal supplied from the timing controller 112. Specifically, in accordance with the scanning control signal, the scanning line drive circuit 114 selects the gate signal lines G one after another, and applies an on-voltage (i.e. supplies a gate signal) to each selected gate signal line G. This causes a switching element of each of pixels P on the selected gate signal line G to be turned on. According to the present embodiment, an n-channel TFT is used for a switching element of each of the pixels P. However, other types of switching elements can be used.

(Signal Line Drive Circuit)

With timings corresponding to the sync signal supplied from the timing controller 112, the signal line drive circuit 120 writes the image data signal (supplied from the timing controller 112) into each of the pixels P on the gate signal lines G driven by the scanning line drive circuit 114. Specifically, the signal line drive circuit 120 applies, via a corresponding one of the source signal lines S, a voltage to each of the pixels P thus driven, which voltage corresponds to the image data signal. This is how an image data signal is written into each of the pixels P.

The image data signal is then supplied to a pixel electrode, which has a liquid crystal capacitance Clc, of each of the pixels P. This causes, in each of the pixels P, an array direction of liquid crystals, with which a space between a pixel electrode having the liquid crystal capacitance Clc and a counter electrode COM is filled, to be changed according to a difference between a voltage of the image data signal and a counter voltage supplied to a counter electrode COM. That is, an image corresponding to the difference is to be displayed.

(Counter Electrode Drive Circuit)

The signal line drive circuit 120 of the present embodiment functions as a counter electrode drive circuit. For example, the signal line drive circuit 120 is capable of supplying, to a counter electrode COM provided in each of the pixels P, a counter voltage VCOM for driving the counter electrode COM.

In particular, the signal line drive circuit 120 of the present embodiment is capable of controlling the counter voltage VCOM. In order to serve this function, the signal line drive circuit 120 includes a VCOM selection circuit 122, a VCOM storage section 124, and a D/A converter 126 (see FIG. 1).

The VCOM storage section 124 stores a plurality of voltage levels of counter voltage VCOM. The plurality of voltage levels include a first electric potential and a second electric potential. The first electric potential and the second electric potential will be described later in detail.

The VCOM selection circuit 122 selects, from the plurality of voltage levels stored in the VCOM storage section 124, a level of voltage to be supplied to the counter electrode COM of each of the pixels P. The VCOM selection circuit 122 selects the level in accordance with a VCOM control signal (counter voltage control signal) supplied from the timing controller 112. The level of voltage selected by the VCOM selection circuit 122 is supplied to the D/A converter 126.

Based on the voltage level (digital signal) thus supplied, the D/A converter 126 generates a counter voltage VCOM (analogue signal) having the voltage level. Then, the D/A converter 126 supplies, to each of the counter electrodes COM, the counter voltage VCOM thus generated.

With this configuration, the display device 100 is capable of switching, as needed, the level of counter voltage VCOM in accordance with the level of a control signal supplied to the VCOM selection circuit 122.

(Example of how to Control Counter Voltage)

Figure 2:
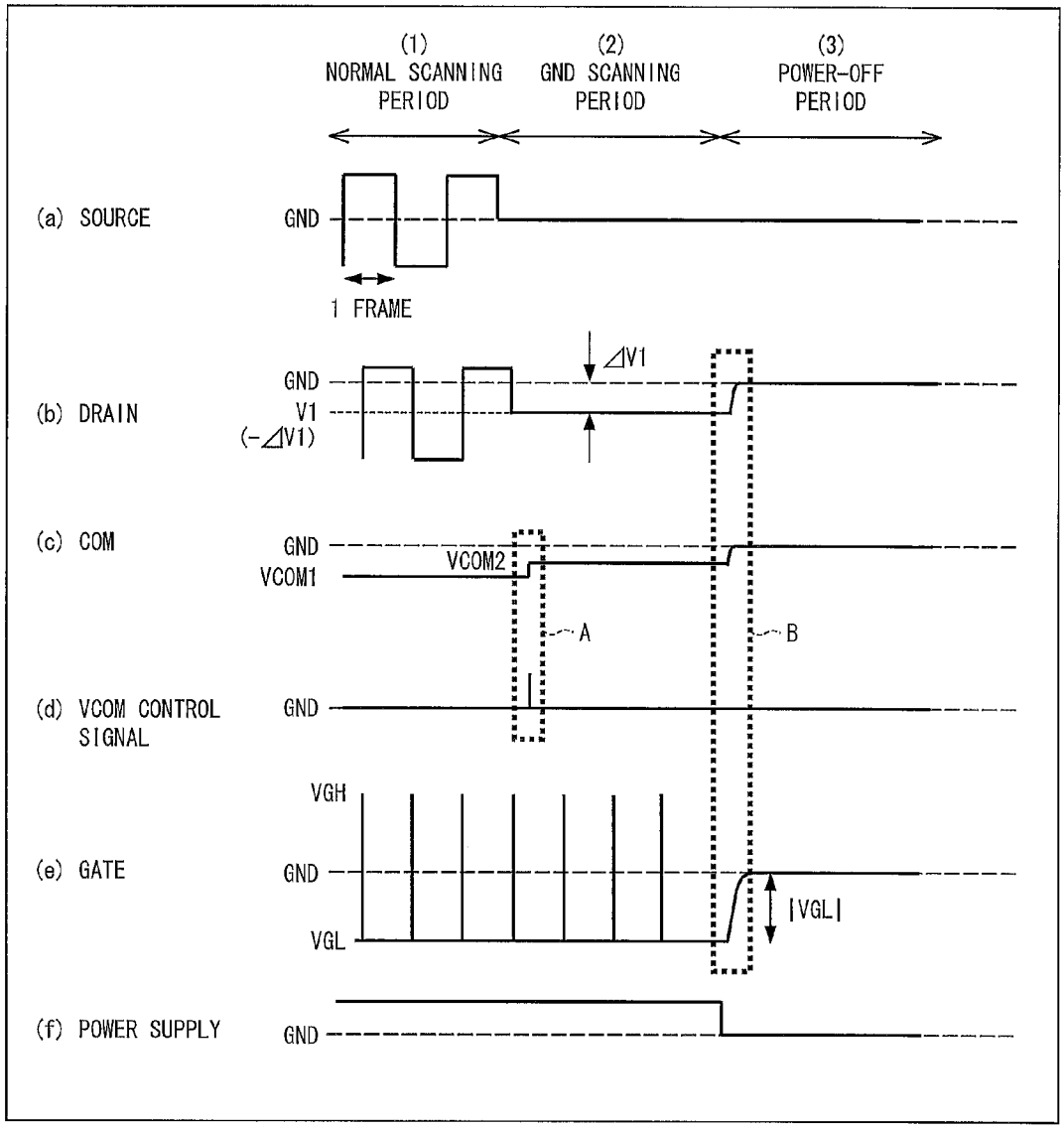
FIG. 2 is a timing chart showing timings of various operations carried out in the display device in accordance with the embodiment.

The following description will discuss, with reference to FIG. 2, an example of how the display device 100 of the present embodiment controls a counter voltage. FIG. 2 is a timing chart showing timings of operations executed in the display device 100. In particular, FIG. 2 illustrates timings of operations when the display device 100 is to be turned off.

(a) of FIG. 2 indicates an electric potential of a source electrode of a TFT provided in a pixel P. (b) of FIG. 2 indicates an electric potential of a drain electrode of the TFT provided in the pixel P. (c) of FIG. 2 indicates an electric potential of a counter electrode COM. (d) of FIG. 2 indicates a waveform of a VCOM control signal. (e) of FIG. 2 indicates an electric potential of a gate electrode of the TFT provided in the pixel P. (f) of FIG. 2 indicates a status of a power supply of the display device 100.

As illustrated in FIG. 2, the display device 100 is configured such that there are a normal scanning period, a GND scanning period, and a power-OFF period. The "normal scanning period" is a period in which to drive the display panel 102 in accordance with an inputted image signal so as to cause the display panel 102 to display an image based on the image signal. The "ground scanning period" is a period in which to write a GND voltage into each of the pixels P before the display device 100 is turned off. The "power-OFF period" is a period in which the display device is turned off.

Operations of the display device 100 during the normal scanning period, the GND scanning period, and the power-OFF period will be described below in detail. Note that while the following description will discuss the operation of the display device 100 in terms of a single pixel P provided in the display panel 102, identical operations are carried out in the other pixels P.

1) Normal Scanning Period

During the normal scanning period, a source electrode of a pixel P first receives corresponding image data from the signal line drive circuit 120 via a corresponding one of the source signal lines S.

In a case where an on-voltage is applied to a gate electrode of the pixel P via a corresponding one of the gate signal lines G, a TFT of the pixel P becomes turned on. This causes the image data, which has been supplied to the source electrode of the pixel P, to be supplied to a drain electrode via the TFT. In other words, the image data is written into the pixel P. Then, an amount of light to be transmitted through liquid crystals in the pixel P is adjusted according to a difference between an electric potential of the drain electrode and an electric potential of a counter electrode COM. This causes an image based on the image data to be displayed. The image data written into the pixel P is maintained in the pixel P until the end of a frame during which the image data is written into the pixel P. Note, however, that in a case where a pausing period is provided after such a frame, the image data may be maintained in the pixel P during the pausing period.

According to the display device 100, the above operation is repeated during the normal scanning period. This causes image data to be written into the pixel P in each frame, and therefore causes an image, which corresponds to the image data, to be displayed. In the example shown in FIG. 2, the display device 100 employs a drive system in which a polarity of image data alternates with every frame. As alternatives, the display device 100 can employ (i) a drive system in which the polarity alternates with every two frames, (ii) a drive system in which a pausing period (pausing frame) is provided in which no image data is to be written into the pixel P, or (iii) the like.

As illustrated in FIG. 2, an electric potential of the drain electrode is shifted toward a negative side from an electric potential of the source electrode by $\Delta V1$. This is because the electric potential of the drain electrode is affected by electric resistances of the TFT and wires, parasitic capacitance, and the like. Therefore, while a reference potential of the source electrode is a GND, a reference potential V1 of the drain electrode is shifted from the negative side from the GND by $\Delta V1$ (i.e. is at $-\Delta V1$). In line with the shifting of the reference potential V1, an electric potential of the counter electrode COM is at VCOM1 which is shifted toward the negative side from the GND by $\Delta V1$ (i.e. is at $-\Delta V1$).

2) Ground Scanning Period

In a case where the display device 100 is turned off, the timing controller 112 receives, from an external source (e.g. a control section in a system), a control signal which instructs the timing controller 112 to turn off the display device 100. When the timing controller 112 receives the control signal, the display device 100 goes into the ground scanning period.

During the ground scanning period, the signal line drive circuit 120 applies, instead of image data, the GND voltage to the source electrode of the pixel P. This causes, during the ground scanning period, the electric potential of the source electrode to be the GND which is a reference potential.

Then, in a case where an on-voltage is applied to the gate electrode of the pixel P via the corresponding one of the gate signal lines G, the TFT of the pixel P becomes turned on. This causes the GND voltage, which has been applied to the source electrode of the pixel P, to be (i) shifted toward the negative side by ΔV1 and (ii) supplied to the drain electrode via the TFT. This causes, during the ground scanning period, the electric potential of the drain electrode to be V1 which is a reference potential.

According to the display device 100 of the present embodiment, the GND voltage is thus written into each of the pixels P before the power supply is turned off so that an electric potential of a drain electrode of each of the pixels P is set to a reference potential. This allows the display device 100 of the present embodiment to be configured such that an electric potential difference between the drain electrodes and the common electrode COM is reduced before the power supply is turned off so that it is possible to prevent a display malfunction which would otherwise occur when the power supply is turned off.

During the ground scanning period, a VCOM control signal is supplied from the timing controller 112 to the signal line drive circuit 120. The VCOM control signal is a signal that commands switching of an electric potential of a counter electrode. In this example, the VCOM control signal is supplied from the timing controller 112. Alternatively, it is also possible to supply a VCOM control signal from an external source (e.g. a control section in a system).

According to the display device 100, the VCOM control signal can be a signal that indicates, in binary (0 and 1), whether the electric potential of the counter electrode is to be switched to a VCOM1 or VCOM2. According to the display device 100, however, other types of signals can be used as a VCOM control signal, provided that a signal is capable of at least identifying what value the electric potential of the counter electrode is to be switched to. For example, it is possible to use, as a VCOM control signal, a signal which is constituted by a plurality of bits and which is capable of serial transfer, such as a signal that employs SPI (Serial Peripheral Interface) or the like.

The signal line drive circuit 120 receives the VCOM control signal, and then switches the electric potential of the counter voltage from the VCOM1 to the VCOM2. This, as indicated by an enclosed region A in FIG. 2, causes the electric potential of the counter electrode COM to be switched from the VCOM1 to the VCOM2.

In this example, since an off-state potential of the gate electrode is negative, the VCOM2 is higher than the VCOM1. In other words, a difference between the VCOM2 and the GND is smaller than a difference between the VCOM1 and the GND.

In a case where the off-state potential of the gate electrode is positive, the VCOM2 is lower than the VCOM1. In such a case also, the difference between the VCOM2 and the GND is smaller than the difference between the VCOM1 and the GND.

Note that, according to the display device 100, the ground scanning period can include a single frame or a plurality of frames.

3) Power-OFF Period

In a case where the display device 100 is turned off, the scanning line drive circuit 114 and the signal line drive circuit 120 stop receiving power.

This, as indicated by an enclosed region B in FIG. 2, causes the electric potential of the gate electrode to be changed from a VGL to the GND. An amount of the change is represented by |VGL|. At the same time, the electric potential of the counter electrode COM changes from the VCOM2 to the GND. An amount of the change is represented by |VCOM2|.

In addition, due to changes in the electric potential of the gate electrode and in the electric potential of the counter electrode COM, the electric potential of the drain electrode changes as well. An amount of the change in the electric potential of the drain electrode corresponds to the amounts of changes in the electric potentials of the gate electrode and of the counter electrode COM.

Therefore, according to the display device 100 of the present embodiment, the electric potential of the counter electrode COM is switched to the VCOM2 before the display device 100 is turned off. In order to cause the electric potential of the drain electrode to change by a proper amount, the VCOM2 is set to a value corresponding to the electric potential of the drain electrode and to the off-state potential of the gate electrode which affect the amount of change in the electric potential of the drain electrode. According to the present embodiment, in particular, the VCOM2 is set so that the electric potential of the drain electrode changes to the GND at time at which the electric potential of the counter electrode COM changes to the GND.

The display device 100 of the present embodiment is thus configured such that in a case where the display device 100 of the present embodiment is turned off, the electric potential of the drain electrode changes to the GND at time at which the electric potentials of the gate electrode and of the counter electrode COM change to the GND (see the enclosed region B in FIG. 2). That is, the display device 100 of the present embodiment can be turned off without causing a difference between the electric potential of the counter electrode COM and the electric potential of the drain electrode.

(Example of Calculating VCOM2)

Figure 3:
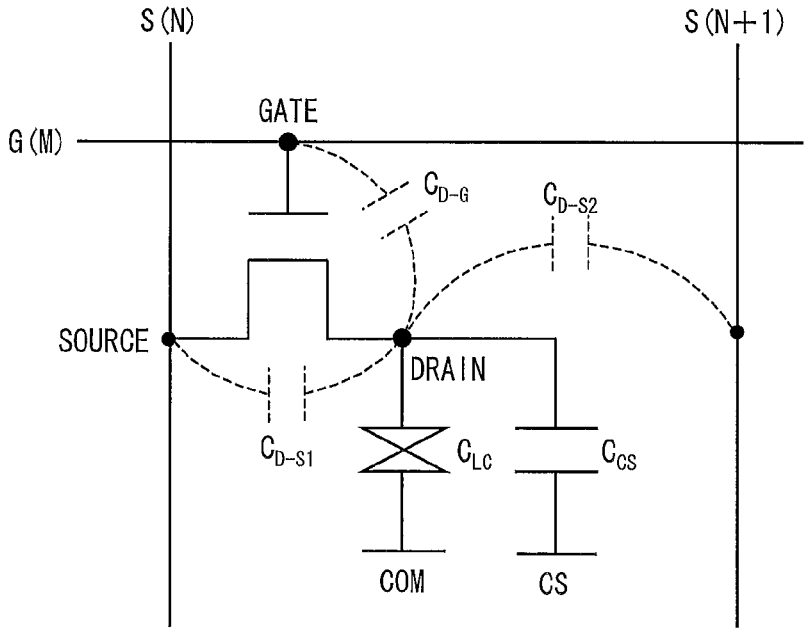
FIG. 3 is an equivalent circuit showing a pixel included in a display panel of the display device in accordance with the embodiment.

The following description will discuss, with reference to FIG. 3, an example of calculating a VCOM2 to be used in the display device 100. FIG. 3 illustrates an equivalent circuit of a pixel P included in the display panel 102. FIG. 3 illustrates a configuration of one of pixels P included in the display panel 102. Note that the identical configuration also applies to the other pixels P included in the display panel 2.

In FIG. 3, (i) $C_{D\text{-}G}$ indicates a gate-to-drain parasitic capacitance, (ii) $C_{D\text{-}S1}$ indicates a source(N)-to-drain parasitic capacitance, (iii) $C_{D\text{-}S2}$ indicates a source(N+1)-to-drain parasitic capacitance, (iv) $C_{LC}$ indicates liquid crystal capacitance, (v) $C_{CS}$ indicates an auxiliary capacitance, (vi) COM indicates an counter electrode, and (vii) CS indicates an auxiliary electrode.

The amount of change in the electric potential of the drain electrode when the display device 100 is turned off can be obtained by use of the following formulae (1) through (3):

$$\beta\times(-VCOM2)+\alpha\times(-VGL) \quad (1)$$

α can be obtained by use of the following formula (2)

$$\alpha=C_{D\text{-}G}/C_{LC}+C_{CS}+C_{D\text{-}G}+C_{D\text{-}S1}+C_{D\text{-}S2}) \quad (2)$$

β can be obtained by use of the following formula (3)

$$\beta=C_{LC}/(C_{LC}+C_{CS}+C_{D\text{-}G}+C_{D\text{-}S1}+C_{D\text{-}S2}) \quad (3)$$

In a configuration in which a COM electrode and a CS electrode are commonly used, in particular, using the following formula (3)' is preferable to using the formula (3):

$$\beta=(C_{LC}+C_{CS})/(C_{LC}+C_{CS}+C_{D\text{-}G}+C_{D\text{-}S1}+C_{D\text{-}S2}) \quad (3)'$$

As described above, when the display device 100 is turned off, the electric potential of the counter electrode COM changes to the GND. Therefore, in order to eliminate a difference between the electric potential of the counter electrode COM and that of the drain electrode, it is necessary to change the electric potential of the drain electrode to the GND. The electric potential of the drain electrode immediately before the display device 100 is turned off is $-\Delta V1$. Hence, in order to change the electric potential of the drain electrode to the GND, it is necessary to change the electric potential of the drain electrode by $\Delta V1$.

Therefore, by setting the VCOM2 so that a calculation result of the above formula (1) (for obtaining the amount of change in the drain electrode) is equal to $\Delta V1$ (i.e. the equation, $-\Delta V1-\beta\times VCOM2=\alpha\times VGL$, is true), it is possible to prevent the difference between the electric potential of the counter electrode COM and that of the drain electrode from occurring when the display device 100 is turned off. It is also possible to refer to $-\Delta V1$ as VCOM1. This is because, as illustrated in FIG. 2, the reference potential V1 of the drain electrode and the electric potential VCOM1 of the counter electrode are essentially identical.

(Effects)

With the display device 100 of the present embodiment, it is thus possible to turn off the display panel 102 without causing a difference between the electric potential of the counter electrode COM and the electric potential of the drain electrode. Therefore, with the configuration of the display device 100 of the present embodiment, it is possible to provide a display device in which defects such as image-stuck pixels and liquid crystal deterioration are unlikely to occur.

According to the display device 100 of the present embodiment, an electric potential VCOM2 is set in view of various electric potentials and various capacitances that affect the amount of change in the electric potential of the drain electrode. This allows the electric potential of the drain electrode to change by a proper amount, and therefore prevents a difference between the electric potential of the counter electrode COM and that of the drain electrode from occurring when the display panel is turned off.

(Pixels of Display Panel 102)

The pixels of the display panel 102 included in the display device 100 of the present embodiment will be described next.

The display device 100 according to each embodiment employs, as a switching element in each of the pixels of the display panel 102, a TFT made of an oxide semiconductor, in particular a TFT made of so-called IGZO (InGaZnOx), which is composed of indium (In), gallium (Ga), and zinc (Zn). The following description will discuss the advantage of a TFT made of an oxide semiconductor.

(TFT Characteristics)

Figure 4:
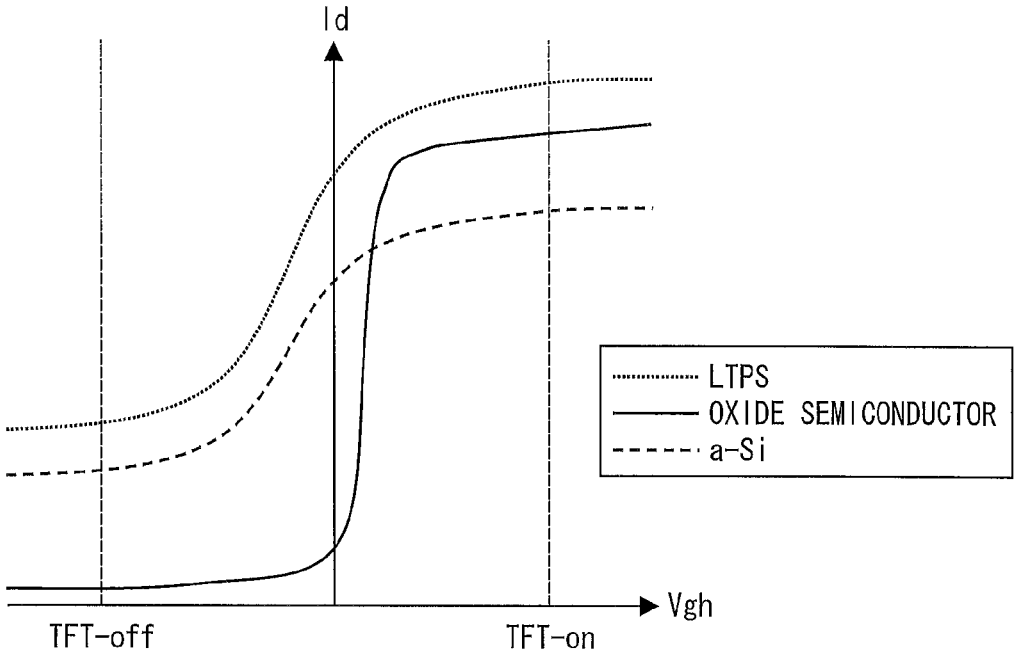
FIG. 4 is a diagram showing characteristics of various TFTs, including a TFT made of an oxide semiconductor.
Figure 5:
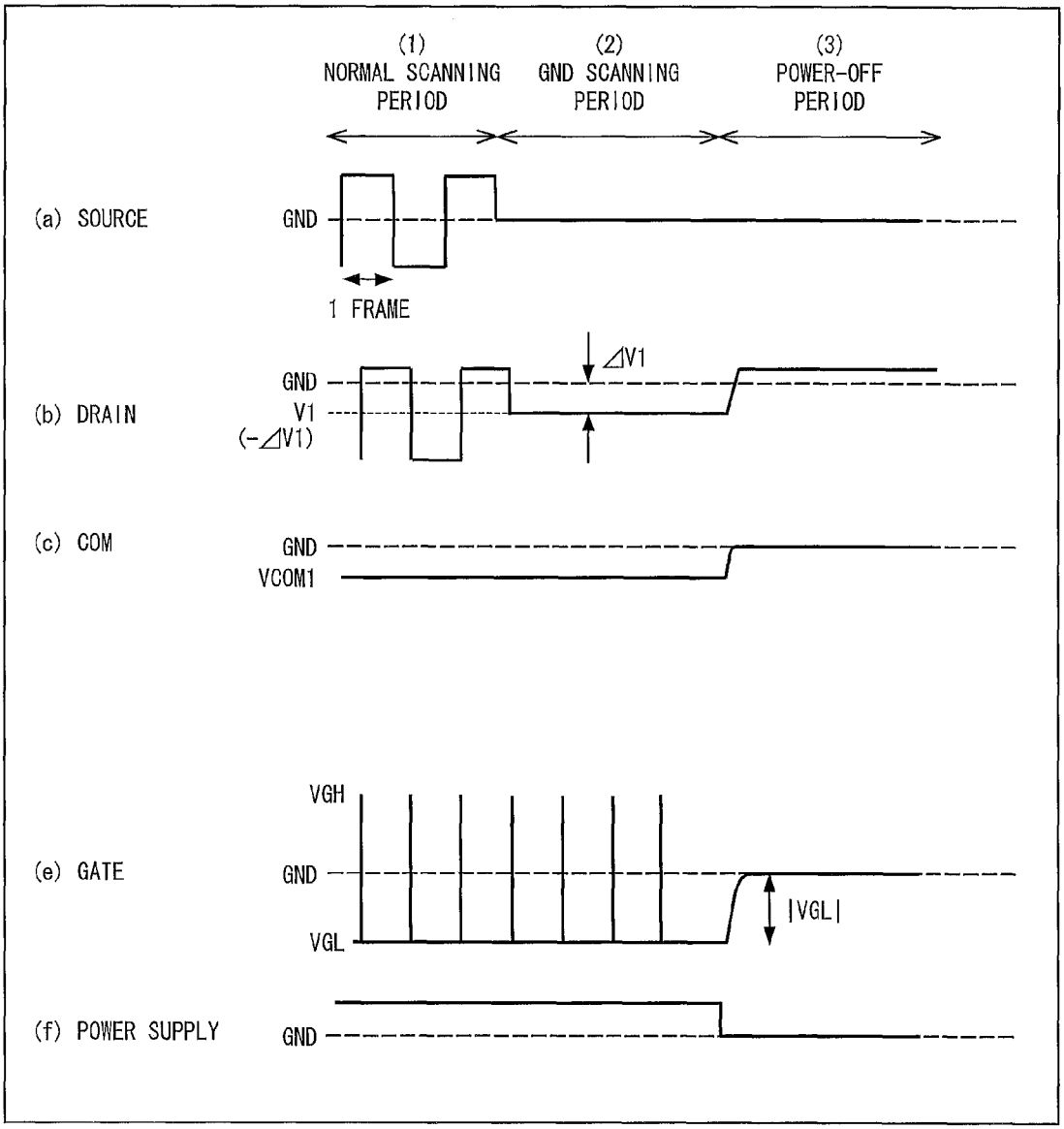
FIG. 5 is a timing chart showing timings of various operations carried out in a conventional display device.

FIG. 4 is a diagram showing the characteristics of various types of TFT, including a TFT made of an oxide semiconductor. FIG. 4 shows the respective characteristics of a TFT made of an oxide semiconductor, a TFT made of a-Si (amorphous silicon), and a TFT made of LTPS (low-temperature polysilicon).

In FIG. 4, the horizontal axis (Vgh) represents the voltage value of ON voltage that is supplied to the gate in each of the TFTs, and the vertical axis (Id) the amount of an electric current between the source and the drain in each of the TFTs. In particular, "TFT-on" in FIG. 4 represents a predetermined on-state voltage, and "TFT-off" in FIG. 4 represents a predetermined off-state voltage.

As shown in FIG. 4, a TFT made of an oxide semiconductor is higher in electron mobility in an on state than a TFT made of a-Si. Specifically, although not illustrated, whereas the TFT made of a-Si has an Id current of 1 uA during the period TFT-on, the TFT made of an oxide semiconductor has an Id current of about 20 uA to 50 uA during the period TFT-on. This shows that the TFT made of an oxide semiconductor is about 20 to 50 times higher in electron mobility in an on state than the TFT made of a-Si and is therefore vastly superior in on-state characteristics.

Further, as shown in FIG. 4, the TFT made of an oxide semiconductor is lower in leak current in an off state than the TFT made of a-Si. Specifically, although not illustrated, whereas the TFT made of a-Si has an Id current of 10 pA during the period TFT-off, the TFT made of an oxide semiconductor has an Id current of about 0.1 pA during the period TFT-off. This shows that the TFT made of an oxide semiconductor is about 1/100 as high in electron mobility in an off state as the TFT made of a-Si and is therefore vastly superior in off-state characteristics, with a leak current hardly occurring.

The display device 100 of the present embodiment employs such a TFT made of an oxide semiconductor (in particular, IGZO) in each of the pixels.

According to the display device 100 of the present embodiment configured as such, the off-state characteristic of a TFT of each of the pixels is superior. This allows each of the pixels of the display panel to remain, for an extended period of time, in a state in which a source signal is written into the pixel. Therefore, the display device 100 of the present embodiment, for example, brings about an effect of easily reducing a refresh rate of the display panel 102.

Meanwhile, since the off-state characteristic of a TFT of each of the pixels is superior according to the display device 100 of the present embodiment, a difference between the electric potential of the drain electrode and that of the counter electrode when the power supply is turned off could be difficult to eliminate. However, the display device 100 employs a configuration that makes such an electric potential difference to occur. Therefore, defects such as image-stuck pixels and liquid crystal deterioration do not occur.

In addition, since the on-state characteristic of a TFT of each of the pixels is superior according to the display device 100 of the present embodiment, it is possible to drive pixels with the use of smaller TFTs. This allows the TFTs to take up a smaller percentage of surface area of the respective pixels. In other words, it is possible to increase an aperture ratio of each pixel so as to increase transmissivity of light from a backlight. As a result, it is possible to employ a low-power-consumption backlight and/or suppress brightness of the backlight. This allows a reduction in power consumption.

Furthermore, since the off-state characteristic of a TFT of each of the pixels is superior according to the display device 100 of the present embodiment, it is possible to reduce an amount of time required for writing a source signal in each of the pixels. This allows an increase in refresh rate of the display panel 102.

(Modification)

According to the display device 100 of the present embodiment, it is GND voltages that are written in the pixels P during a ground scanning period. However, the present invention is not limited to such a configuration. In fact, voltages to be written in the pixels P can be voltages other than the GND voltage, provided that the voltages can cause respective drain potentials of the pixels to be all identical.

In addition, voltages to be written in the pixels P can differ from each other with every pixel (or with every predetermined number of pixels). For example, there are cases where, due to variation in characteristics of a plurality of pixels, application of identical GND voltages to the respective pixels still results in varying drain potentials.

In such a case, in order to prevent variation in the drain potentials, the display device 100 may be configured to apply voltages that differ from each other with every pixel. For example, the display device 100 can be configured such that (i) a voltage, which is to be applied to a pixel that would have a drain potential lower than a target reference potential by a certain amount, is increased by an amount corresponding to the certain amount and (ii) a voltage, which is to be applied to a pixel that would have a drain potential higher than a target reference potential by a certain amount, is decreased by an amount corresponding to the certain amount.

In such a case, the display device 100 is preferably configured to (i) store respective voltages or correction values of the pixels in a memory or the like and (ii) cease, during the ground scanning period, alternating a polarity with every frame.

(Supplementary Explanation)

The present invention is not limited to the description of the embodiments, but can be altered in many ways by a person skilled in the art within the scope of the claims. An embodiment derived from a proper combination of technical means disclosed in different embodiments is also encompassed in the technical scope of the present invention.

According to the embodiment, the signal line drive circuit 120 has a function as a counter electrode drive circuit. However, the present invention is not limited to such a configuration. In fact, the function of a counter electrode drive circuit can be fulfilled in any manner, provided that the function is at least fulfilled within the display drive circuit 110.

According to the embodiment, a VCOM2 to be used in the display device 100 is calculated in advance and is stored in the VCOM storage section 124. However, the present invention is not limited to such a configuration. In fact, it is also possible, for example, to provide a calculating section in the display drive circuit 110 and to cause the calculating section to calculate a second electric potential. In such a case, the calculating section can calculate the second electric potential by use of the formulae described in the embodiment. In addition, the calculating section can calculate the second electric potential at least before switching an electric potential of the counter electrode COM to the second electric potential.

The embodiment discussed the example of applying, to the present invention, a display device in which TFTs each made of an oxide semiconductor (particularly IGZO) is used for the pixels. However, the present invention is not limited to such an example. In fact, it is also possible to apply, to the present invention, display devices in which other TFTs such as those made of a-Si or LTPS are used for pixels.

According to the embodiment, an electric potential of the counter electrode COM is preferably switched from a VCOM1 to a VCOM2 while a GND voltage is written in a corresponding one of the pixels P. However, the present invention is not limited to such a configuration. In fact, it is also possible, for example, to switch the electric potential of the counter electrode COM before writing the GND voltage in the corresponding one of the pixels P.

According to the embodiment, a GND voltage is preferably written in each of the pixels P before the display device 100 is turned off. Alternatively, it is also possible to configure the display device 100 such that no GND voltage is written in any pixels.

According to the embodiment, the signal line drive circuit 120 switches a counter voltage from a VCOM1 to a VCOM2 in response to a VCOM control signal received from an external source. Alternatively, it is also possible to configure the signal line drive circuit 120 to, without using a VCOM control signal, (i) detect it when the display device 100 is turned off and then (ii) automatically switch the counter voltage from the VCOM1 to the VCOM2 with any timing.

SUMMARY

As describe above, a drive device in accordance with an embodiment of the present invention is a drive device for driving a display panel, said display panel including: pixels; gate signal lines; and source signal lines, said drive device including: a scanning line drive circuit for selecting and scanning the gate signal lines one after another; a signal line drive circuit for writing a data signal (i) into each of selected pixels connected to a selected one of the gate signal lines and (ii) via a corresponding one of the source signal lines; and switching means for switching, before the display panel is turned off, an electric potential of a counter electrode of each of the pixels from a first electric potential to a second electric potential which causes an electric potential of a drain electrode of the each of the pixels to be identical to the electric potential of the counter electrode after the display panel is turned off.

The amount of change in electric potential of the drain electrode, which change occurs when the display panel is turned off, is affected by the electric potential of the counter electrode at the time. According to the drive device, the electric potential of the counter electrode is switched to the second electric potential before the display panel is turned off, so that the amount of change in electric potential of the drain electrode is set to a proper amount. This prevents the occurrence of a difference between the electric potential of the counter electrode and the electric potential of the drain electrode when the display panel is turned off. In other words, with the drive device, it is possible to turn off the display panel without causing the electric potential difference.

The drive device is preferably configured such that the switching means switches the electric potential of the counter electrode of the each of the pixels from the first electric potential to the second electric potential which corresponds to an off-state potential of a gate electrode of the each of the pixels.

The amount of change in electric potential of the drain electrode, which change occurs when the display panel is turned off, is affected also by the electric potential of the gate electrode at the time. Therefore, in order to change the drain potential to a target electric potential, it is necessary to take into account the electric potential of the gate electrode before the drain potential changes. Furthermore, in order to change the electric potential of the drain electrode to a target electric potential, it is also necessary to take into account the electric potential of the drain electrode before it changes. Note that since the electric potential of the drain electrode before the change is practically identical to the first electric potential, it is possible that the first electric potential, instead of the electric potential of the drain electrode before change, is taken into account.

According to the configuration, the use is made of (i) the first electric potential (i.e. the electric potential of the drain electrode before the change) that affects the amount of change in electric potential of the drain electrode and (ii) the second electric potential which is set in view of the electric potential of the gate electrode. This results in a proper amount of change in electric potential of the drain electrode, and therefore prevents the occurrence of the difference between the electric potential of the counter electrode and the electric potential of the drain electrode when the display panel is turned off.

The drive device is preferably configured such that, in a case where (i) the first electric potential is a VCOM1, (ii) the second electric potential is a VCOM2, and (iii) the off-state potential of the gate electrode is a VGL, the second electric potential is set to satisfy the all of the following formulae (1) through (3):

$$(V\mathrm{COM1}-\beta\times V\mathrm{COM2})=\alpha\times VGL \quad (1)$$

$$\alpha=C_{D\text{-}G}/(C_{LC}+C_{CS}+C_{D\text{-}G}+C_{D\text{-}S1}+C_{D\text{-}S2}) \quad (2)$$

$$\beta=C_{LC}/(C_{LC}+C_{CS}+C_{D\text{-}G}+C_{D\text{-}S1}+C_{D\text{-}S2}) \quad (3)$$

wherein (i) $C_{D\text{-}G}$ is a gate-to-drain parasitic capacitance, (ii) $C_{D\text{-}S1}$ is a source(N)-to-drain parasitic capacitance, (iii) $C_{D\text{-}S2}$ is a source(N+1)-to-drain parasitic capacitance, (iv) $C_{LC}$ is a liquid crystal capacitance, and (v) $C_{CS}$ is an auxiliary capacitance.

The drive device is preferably configured such that, with respect to a pixel including an electrode serving as the counter electrode and as an auxiliary electrode, the second electric potential is set to satisfy, instead of the formula (3), the following formula (3)':

$$\beta=(C_{LC}+C_{CS})/(C_{LC}+C_{SC}+C_{D\text{-}G}+C_{D\text{-}S1}+C_{D\text{-}S2}) \quad (3)'.$$

According to the configuration, the use is made of the second electric potential that is set with the above capacitances further taken into account, which capacitances affect the amount of change in electric potential of the drain electrode. This results in a more proper amount of change in electric potential of the drain electrode, and therefore further prevents the occurrence of the difference between the electric potential of the counter electrode and the electric potential of the drain electrode when the display panel is turned off.

The drive device is preferably configured such that the signal line drive circuit writes a GND voltage into the each of the selected pixels before the display panel is turned off.

With the configuration, it is possible to cause the drain potential of each of the selected pixels to be identical to the GND potential. In other words, it is possible to eliminate a difference in drain potential between the TFTs within the display panel. This allows the effect of the present invention to be, without exception, extended all over the panel.

The drive device is preferably configured such that the switching means switches the electric potential of the counter electrode from the first electric potential to the second electric potential while the signal line drive circuit is writing the GND voltage into the each of the selected pixels.

With the configuration, it is possible to switch the electric potential of the counter electrode from the first electric potential to the second electric potential while the GND voltage is being written, that is, before writing of the GND voltage ends. Therefore, it is possible, for example, to turn off the display panel as soon as the writing of the GND voltage ends. This allows a reduction in length of time required for a process of turning off the display panel.

After writing of the GND voltage ends, in particular, the gate electrode is normally turned off. Therefore, switching the electric potential of the counter electrode from the first electric potential to the second electric potential causes the drain voltage to be changed along with the change in counter voltage. This results in little change in an electric potential difference between both ends of a liquid crystal capacitance, and therefore prevents the effect of the present invention from being sufficiently produced. In addition, before writing of the GND voltage, an image of some sort is displayed. Therefore, if the switching is made with such a timing, then it causes the pixels to have largely differing effective voltage of image data. This results in a display malfunction. Therefore, by employing the configuration in which the writing of the GND voltage and the switching of the electric potential of the counter electrode are simultaneously carried out, it is possible to write the GND voltage and to switch the electric potential of the counter electrode without causing the display malfunction.

The drive device is preferably configured such that the signal line drive circuit starts writing the GND voltage into the each of the selected pixels with a timing which is controlled by a control signal supplied from a source outside of the drive device.

With the configuration, it is possible to write the GND voltage and to switch the electric potential of the counter electrode with a proper timing in accordance with a request made by an external source.

The drive device is preferably configured such that the second electric potential is (i) higher than the first electric potential in a case where a polarity of the off-state potential of the gate electrode is negative and (ii) lower than the first electric potential in a case where a polarity of the off-state potential of the gate electrode is positive.

The configuration, regardless of whether the polarity of the off-state potential of the gate electrode is positive or negative, makes it possible to use a proper electric potential as a second electric potential to turn off the display panel without causing a difference between the electric potential of the drain electrode and the electric potential of the counter electrode.

The drive device is preferably configured such that the signal line drive circuit alternately writes, into the each of the selected pixels, (i) data signals whose polarities are positive and (ii) data signals whose polarities are negative.

With the configuration, it is possible to write, in balance, positive data signals and negative data signals into each of the selected pixels. This prevents pixel characteristics from leaning toward one polarity. In addition, with the configuration, it is possible to cause the electric potential of the counter electrode of each of the selected pixels to become close to the GND before the display panel is turned off. Therefore, it is possible to suppress the amount of change in electric potential of the counter electrode when the display panel is turned off. This makes it possible to suppress the amount of change in electric potential of the drain electrode, and ultimately makes it possible to highly precisely control the amount of change in electric potential of the drain electrode.

A display device in accordance with the embodiment of the present invention includes: a display panel including pixels, gate signal lines, and source signal lines; and the drive device.

With the display device, it is possible to produce effects similar to those produced by the drive device.

The display device is preferably configured such that the pixels are liquid crystal pixels.

According to this configuration, defects caused by the electric potential difference, such as image sticking and deterioration of each of the pixels, can easily occur. Therefore, the effect of the above configuration, in which the electric potential difference is prevented from occurring, is more advantageous.

The display device is preferably configured such that a semiconductor layer of a switching element of each of the pixels is made of an oxide semiconductor. In particular, the display device is preferably configured such that the oxide semiconductor is IGZO.

According to this configuration, an electric potential difference, which has occurred between the drain electrode and the counter electrode when the display device is turned off, is difficult to eliminate. Therefore, the effect of the above configuration, in which the electric potential difference is prevented from occurring, is more advantageous.

INDUSTRIAL APPLICABILITY

A display device according to an embodiment of the present invention is applicable to various display devices each including a plurality of pixels. A drive device according to an embodiment of the present invention is applicable to various drive devices for driving such display devices.

REFERENCE SIGNS LIST

100 Display device
102 Display panel
110 Display drive circuit (drive device)
112 Timing controller
113 Power generating circuit
114 Scanning line drive circuit
120 Signal line drive circuit
122 VCOM selection circuit (switching means)
124 VCOM storage section
126 D/A converter

The invention claimed is:

1. A drive device for driving a display panel, the display panel comprising:
pixels;
gate signal lines; and
source signal lines,
the drive device comprising:
a scanning line drive circuit for selecting and scanning the gate signal lines one after another; and
a signal line drive circuit for writing a data signal (i) into each of selected pixels connected to a selected one of the gate signal lines and (ii) via a corresponding one of the source signal lines; wherein
before the display panel is turned off, an electric potential of a counter electrode of each of the pixels is changed from a first electric potential to a second electric potential which causes an electric potential of a drain electrode of the each of the pixels to be identical to the electric potential of the counter electrode after the display panel is turned off;
the second electric potential is calculated based on the first electric potential and an off-state potential of a gate electrode of each of the pixels,
wherein, the second electrical potential is set to satisfy all of the following formulae (1) through (3):

$$(VCOM1-\beta\times VCOM2)=\alpha\times VGL \quad (1)$$

$$\alpha=C_{D\text{-}G}/(C_{LC}+C_{CS}+C_{D\text{-}G}+C_{D\text{-}S1}+C_{D\text{-}S2}) \quad (2)$$

$$\beta=C_{LC}/(C_{LC}+C_{CS}+C_{D\text{-}G}+C_{D\text{-}S1}+C_{D\text{-}S2}) \quad (3)$$

wherein (i) VCOM1 is the first electric potential, (ii) VCOM2 is the second electric potential, (iii) VGL is the off-state potential of the gate electrode, (iv) $C_{D\text{-}G}$ is a gate-to-drain parasitic capacitance, (v) $C_{D\text{-}S1}$ is a source(N)-to-drain parasitic capacitance, (vi) $C_{D\text{-}S2}$ is a source(N+1)-to-drain parasitic capacitance, (vii) $C_{LC}$ is a liquid crystal capacitance, and (viii) $C_{CS}$ is an auxiliary capacitance.

2. The drive device as set forth in claim 1, wherein, the second electric potential is set to satisfy all of the following formulae (1) through (3)':

$$(VCOM1-\beta\times VCOM2)=\alpha\times VGL \quad (1)$$

$$\alpha=C_{D\text{-}G}/(C_{LC}+C_{CS}+C_{D\text{-}G}+C_{D\text{-}S1}+C_{D\text{-}S2}) \quad (2)$$

$$\beta=(C_{LC}+C_{CS})/(C_{LC}+C_{SC}+C_{D\text{-}G}+C_{D\text{-}S1}+C_{D\text{-}S2}) \quad (3)'$$

wherein (i) VCOM1 is the first electric potential, (ii) VCOM2 is the second electric potential, (iii) VGL is the off-state potential of the gate electrode, (iv) $C_{DG}$ is a gate-to-drain parasitic capacitance, (v) $C_{D\text{-}S2}$ is a source(N)-to-drain parasitic capacitance, (vi) $C_{D\text{-}S2}$ is a source(N+1)-to-drain parasitic capacitance, (vii) $C_{LC}$ is a liquid crystal capacitance, and (viii) $C_{CS}$ is an auxiliary capacitance.

3. The drive device as set forth in claim 1, wherein the signal line drive circuit writes a ground voltage into the each of the selected pixels before the display panel is turned off.

4. The drive device as set forth in claim 3, wherein the electric potential of the counter electrode is switched from the first electric potential to the second electric potential while the signal line drive circuit is writing the ground voltage into the each of the selected pixels.

5. The drive device as set forth in claim 3, wherein the signal line drive circuit starts writing the ground voltage into the each of the selected pixels with a timing which is controlled by a control signal supplied from a source outside of the drive device.

6. The drive device as set forth in claim 1, wherein:
when a polarity of the off-state potential of the gate electrode is negative, the second electric potential is higher than the first electric potential; and
when the polarity of the off-state potential of the gate electrode is positive, the second electric potential is lower than the first electric potential.

7. The drive device as set forth in claim 1, wherein the signal line drive circuit alternately writes, into the each of the selected pixels, (i) data signals whose polarities are positive and (ii) data signals whose polarities are negative.

8. A display device comprising:
a display panel including pixels, signal lines, and source signal lines; and
a drive device as set forth in claim 1.

9. The display device as set forth in claim 8, wherein each of the pixels is a liquid crystal pixel.

10. The display device as set forth in claim 8, wherein a semiconductor layer of a switching element of each of the pixels is made of an oxide semiconductor.

11. The display device as set forth in claim 10, wherein the oxide semiconductor includes indium (In), gallium (Ga) and zinc (Zn).

12. The drive device as set forth in claim 1, further comprising a timing controller; wherein
the electric potential of the counter electrode of the each of the pixels is switched from the first electric potential to the second electric potential according to a control signal supplied from the timing controller.

13. A method for driving a display panel of a display device, comprising:
receiving at the display panel a control signal that instructs the display panel to turn off;
switching an electric potential of a counter electrode of each of a plurality of pixels of the display panel from a first electric potential to a second electric potential; and
turning off the display panel by terminating a supply of power to the display device; wherein
the second electrical potential causes an electric potential of a drain electrode of each of the plurality of pixels to be identical to the electric potential of the counter electrode after the display panel is turned off; and
the second electric potential is calculated based on the first electric potential and an off-state potential of a gate electrode of each of the pixels, wherein,
the second electrical potential is set to satisfy all of the following formulae (1) through (3):

$$(VCOM1-\beta\times VCOM2)=\alpha\times VGL \quad (1)$$

$$\alpha=C_{D\text{-}G}/(C_{LC}+C_{CS}+C_{D\text{-}G}+C_{D\text{-}S1}+C_{D\text{-}S2}) \quad (2)$$

$$\beta=C_{LC}/(C_{LC}+C_{CS}+C_{D\text{-}G}+C_{D\text{-}S1}+C_{D\text{-}S2}) \quad (3)$$

wherein (i) VCOM1 is the first electric potential, (ii) VCOM2 is the second electric potentials, (iii) VGL is the off-state potential of the gate electrode, (iv) $C_{D\text{-}G}$ is a gate-to-drain parasitic capacitance, (v) $C_{D\text{-}S1}$ is a source(N)-to-drain parasitic capacitance, (vi) $C_{D\text{-}S2}$ is a source(N+1)-to-drain parasitic capacitance, (vii) $C_{LC}$ is a liquid crystal capacitance, and (viii) $C_{CS}$ is an auxiliary capacitance.

* * * * *